US009788093B2

(12) United States Patent
Ozcan

(10) Patent No.: US 9,788,093 B2
(45) Date of Patent: Oct. 10, 2017

(54) AUDIO TRANSDUCER ELECTRICAL CONNECTIVITY

(71) Applicant: Nokia Corporation, Espoo (FI)

(72) Inventor: Koray Ozcan, Farnborough Hampshire (GB)

(73) Assignee: Nokia Technologies Oy, Espoo (FI)

( * ) Notice: Subject to any disclaimer, the term of this patent is extended or adjusted under 35 U.S.C. 154(b) by 0 days.

(21) Appl. No.: 14/452,775

(22) Filed: Aug. 6, 2014

(65) Prior Publication Data

US 2016/0044397 A1 Feb. 11, 2016

(51) Int. Cl.

| | |
|---|---|
| ***H04R 25/00*** | (2006.01) |
| ***H04R 1/06*** | (2006.01) |
| *H04R 1/02* | (2006.01) |
| *H04R 31/00* | (2006.01) |

(52) U.S. Cl.

CPC ..... *H04R 1/06* (2013.01); *H04R 1/028* (2013.01); *H04R 1/025* (2013.01); *H04R 31/006* (2013.01); *H04R 2209/024* (2013.01); *H04R 2499/11* (2013.01)

(58) Field of Classification Search

CPC ..... H04R 2499/11; H04R 9/06; H04R 1/225; H04R 9/02; H04R 1/00; H04R 1/02; H04R 1/021; H04R 1/028; H04R 1/06; H04R 1/22; H04R 1/2811; H04R 1/2842; H04R 1/2857; H04R 1/2888; H04R 2400/03; H04R 2499/15; H04R 31/00; H04R 7/14; H04R 7/20; H04R 9/025; H04R 7/025; H04R 31/006; H04R 2209/024

USPC ..... 381/334, 333, 351, 407, 386, 388; 345/173; 455/550.1, 575.1, 575.8, 569.1; 379/433.02

See application file for complete search history.

(56) References Cited

U.S. PATENT DOCUMENTS

| | | | | |
|---|---|---|---|---|
| 3,118,022 | A | 1/1964 | Sessler et al. | 179/111 |
| 5,788,516 | A | 8/1998 | Uggmark | |
| 6,201,876 | B1 | 3/2001 | Niemi et al. | 381/355 |
| 6,438,249 | B1 | 8/2002 | Wiener | |
| 6,875,743 | B1 * | 4/2005 | Lin | A61K 38/04 424/185.1 |
| 8,692,635 | B2 | 4/2014 | Slotte | 335/220 |

(Continued)

FOREIGN PATENT DOCUMENTS

| | | | |
|---|---|---|---|
| DE | 42 15 271 | A1 | 11/1993 |
| EP | 0740878 | A1 | 11/1996 |
| WO | WO-2014/083952 | A1 | 6/2014 |

OTHER PUBLICATIONS

"Tutorial for MEMS microphones", Application note AN4426, ST Microelectronics, Jan. 2014, 18 pgs.

(Continued)

*Primary Examiner* — Davetta W Goins
*Assistant Examiner* — Phylesha Dabney
(74) *Attorney, Agent, or Firm* — Harrington & Smith

(57) ABSTRACT

An apparatus including an audio transducer configured to generate sound and a structure configured to physically mount the transducer to another member. The transducer includes a housing, a diaphragm and a driver configured to move the diaphragm. The structure at least partially includes the housing. The structure includes at least one portion which is electrically conductive. The at least one portion is electrically connected to the driver.

30 Claims, 4 Drawing Sheets

(56) References Cited

U.S. PATENT DOCUMENTS

2005/0047621 A1* 3/2005 Cranfill ..... B06B 1/045
381/334
2013/0170685 A1* 7/2013 Oh ..... H04R 1/2888
381/334

OTHER PUBLICATIONS

"Electret Condenser Microphone", SoniCrest Acoustic Components, Jul. 31, 2014, 4 pgs.

* cited by examiner

AUDIO TRANSDUCER ELECTRICAL CONNECTIVITY

BACKGROUND

Technical Field

The exemplary and non-limiting embodiments relate generally to a sound transducer and, more particularly, to electrical connectivity for a sound transducer.

Brief Description of Prior Developments

A conventional speaker, such as used in a portable device such as a smartphone for example, has spring contacts to connect the leads of the coil to another member, such as a printed wiring board for example.

SUMMARY

The following summary is merely intended to be exemplary. The summary is not intended to limit the scope of the claims.

In accordance with one aspect, an example embodiment is provided in an apparatus including an audio transducer configured to generate sound and a structure configured to physically mount the transducer to another member. The transducer includes a housing, a diaphragm and a driver configured to move the diaphragm. The structure at least partially includes the housing. The structure includes at least one portion which is electrically conductive. The at least one portion is electrically connected to the driver.

In accordance with another aspect, an example method comprises providing an audio transducer configured to generate sound, where the transducer comprises a housing, a diaphragm and a driver configured to move the diaphragm; providing an arrangement which is configured to physically mount the transducer to another member, where at least one portion of the arrangement is electrically conductive, and where the arrangement at least partially comprises the housing; and connecting the driver electrically to the at least one portion.

In accordance with another aspect, an example embodiment is provided in an apparatus comprising an audio transducer configured to generate sound, where the transducer comprises a housing, a diaphragm and a driver configured to move the diaphragm; and a gasket connected to the housing, where the gasket comprises at least one portion which is electrically conductive, and where the at least one portion is electrically connected to the driver.

BRIEF DESCRIPTION OF THE DRAWINGS

The foregoing aspects and other features are explained in the following description, taken in connection with the accompanying drawings, wherein.

DETAILED DESCRIPTION OF EMBODIMENTS

Figure 1:
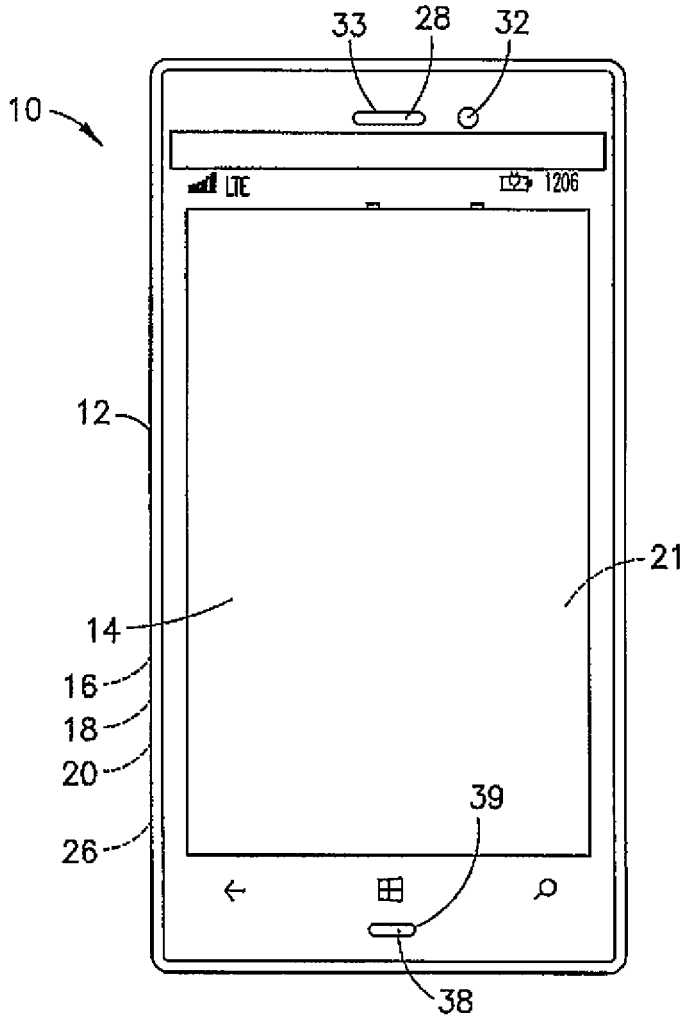
FIG. 1 is a front view of an example embodiment of an apparatus comprising features as described herein.

Referring to FIG. 1, there is shown a front view of an apparatus 10 incorporating features of an example embodiment. Although the features will be described with reference to the example embodiments shown in the drawings, it should be understood that features can be embodied in many alternate forms of embodiments. In addition, any suitable size, shape or type of elements or materials could be used.

The apparatus 10 may be a hand-held portable apparatus or portable electronic device, such as a communications device which includes a telephone application for example. However features as described herein may be used in other electronic devices such as, for example, a laptop, a desktop computer, a personal computer, a television remote control, a camera or video recorder, a handheld gaming device, a game handset, or other electronic devices which may be classified as a portable electronic device.

In the example shown the apparatus 10 is a smartphone which includes a camera and a camera application. The apparatus 10 may additionally or alternatively comprise an Internet browser application, a video recorder application, a music player and recorder application, an email application, a navigation application, a gaming application, and/or any other suitable electronic device application. As noted above, in an alternate example embodiment the apparatus might not be a smartphone.

Figure 2:
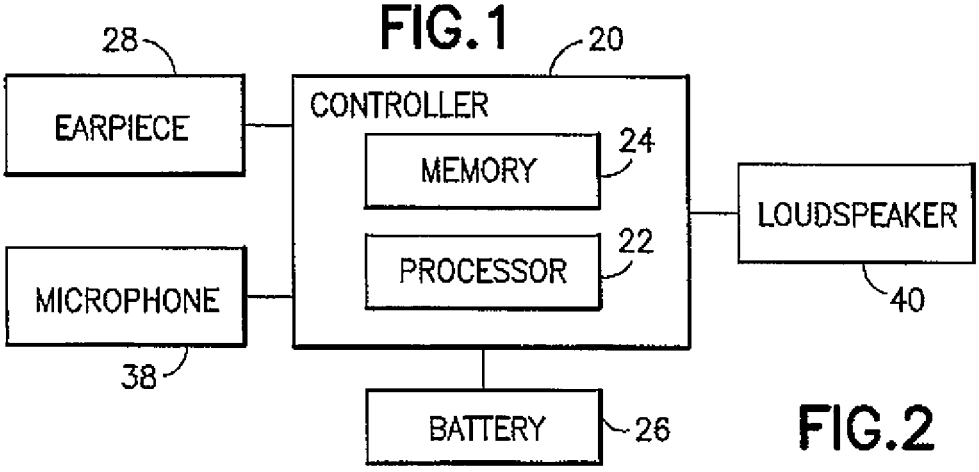
FIG. 2 is a diagram illustrating some of the components of the apparatus shown in FIG. 1.

The apparatus 10, in this example embodiment, comprises a housing 12, a touchscreen 14, a receiver 16, a transmitter 18, a controller 20, a rechargeable battery 26 and at least one camera. However, all of these features are not necessary to implement the features described below. The receiver and the transmitter may be provided in the form of a transceiver for example. Referring also to FIG. 2, the controller 20 may include at least one processor 22, at least one memory 24, and software. The electronic circuitry inside the housing 12 may comprise at least one printed wiring board (PWB) 21 having components such as the controller 20 thereon. The receiver 16 and transmitter 18 form a primary communications system to allow the apparatus 10 to communicate with a wireless telephone system, such as a mobile telephone base station for example.

In this example, the apparatus 10 includes a main camera (not shown) which is located at the rear side of the apparatus 10, a front camera 32, and a flash system (not shown) at the rear side. The cameras and the flash system are connected to the controller 20 such that the controller 20 may control their operation. In an alternate example embodiment the rear side may comprise more than one camera, and/or the front side could comprise more than one camera. The apparatus 10 includes a sound transducer provided as an air microphone 38. In an alternate example the apparatus may comprise more than one air microphone.

The apparatus 10 also includes a speaker or earpiece 28 which comprises a sound transducer or audio transducer. Another speaker 40 (see FIG. 2) may be provided with an output such as at a rear side or lateral side of the housing. The housing 12 comprises at least one sound hole 33 in the front side for sound to travel from the earpiece 28, at least one sound hole 39 in the front side for sound to travel to the microphone 38, and one or more sound holes in the housing for sound to travel from the speaker 40. The description which follows will be in regard to the area at the speaker 40.

However, the features described are equally applicable to other coil/magnet assemblies. Features of the invention could be used at the earpiece 28 for example. As well as earpieces, features as described herein may be used for a handsfree speaker or a multi-function-device which is moving coil transducer.

Figure 3:
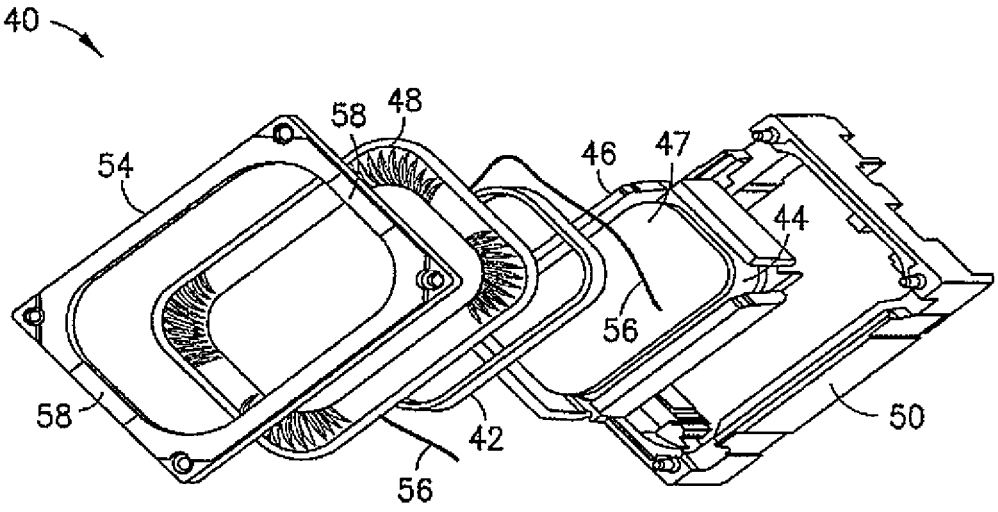
FIG. 3 is an exploded perspective view of the loudspeaker shown in FIG. 2.

Referring also to FIG. 3, an exploded view of the speaker 40 is shown. In this example the diaphragm 48 of the speaker 40 has its outer perimeter connected to a main section of the housing 50 by a front cover 54 of the housing 50. The speaker 40 includes a coil 42, a magnet 44 (such as one or more permanent magnets or electromagnet(s) for example), and pole pieces 46, 47. The coil 42 provides the transducer with the ability to function as a dynamic moving coil transducer. The coil 42 has electrical leads 56.

Figure 4:
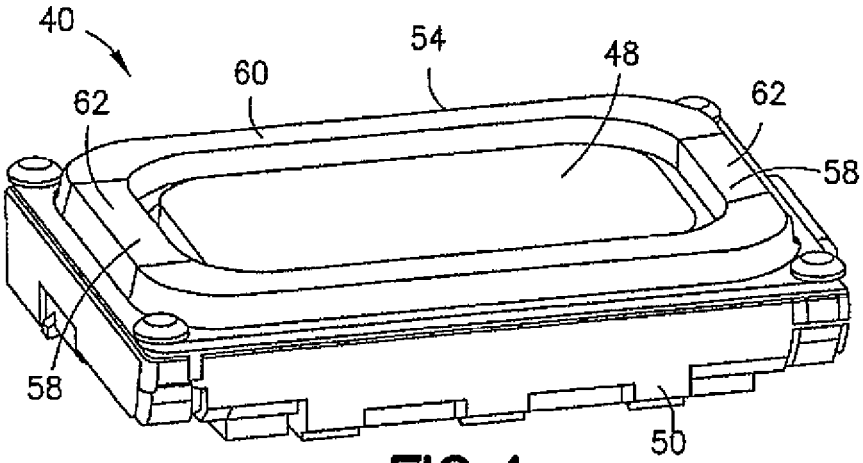
FIG. 4 is a perspective view of the speaker shown in FIG. 3.

Referring also to FIG. 4, the front cover 54 of the housing 50 has two electrically conductive sections or portions 58. In one type of embodiment the cover 54 may comprise a molded dielectric polymer material having the portions 58 formed thereon as conductors such as conductive traces for example. There may be different chassis or cover designs which encapsulate the diaphragm/coil/magnet assembly. There are metallic covers and plastic device covers. If such device cover is metallic, then some kind of insulation may be provided between conductive sections so as to drive the transducer. The cover may be divided into two or more sections by a narrow insulation to separate the cover so that the speaker transducer can be driven. The size and shape of such conductive sections can be designed in any form. The conductive sections can be molded in manufacturing, or printed or laser glued, so all manufacturing techniques can be used here.

In an alternate example the dielectric portion of the cover may be overmolded onto the portions 58. The portions 58 may comprises molded electrically conductive material or metal members to function as terminals for the transducer. The cover 54, including the portions 58, are substantially rigid in this example, but may be slightly resilient. The front face 60 of the cover 54 forms two electrical contact areas or pads 62 at the portions 58. In this example the electrical contact areas or contact areas 62 form a stationary part of the housing. The electrical contact areas or contact areas 62 may be integrally formed with the rest of the cover 54 and form at least part of the cover 54. The leads 56 of the coil 42 are in electrical contact with respective ones of the portions 58 under the cover 54. The portions 58 are, thus, able to provide an electrical interface with the coil 42 via the contact areas 62 at the front face 60 of the cover 54.

The transducer 40 may be directly mounted to the housing 12 of the apparatus 10 with one or both of the contact areas 62 making direct electrical contact to conductors on the housing 12 or a frame inside the housing. Alternatively, or additionally, the transducer 40 may be directly mounted to the printed wiring board 21 with one or both of the contact areas 62 making direct electrical contact to conductors on the printed wiring board 21.

Figure 5:
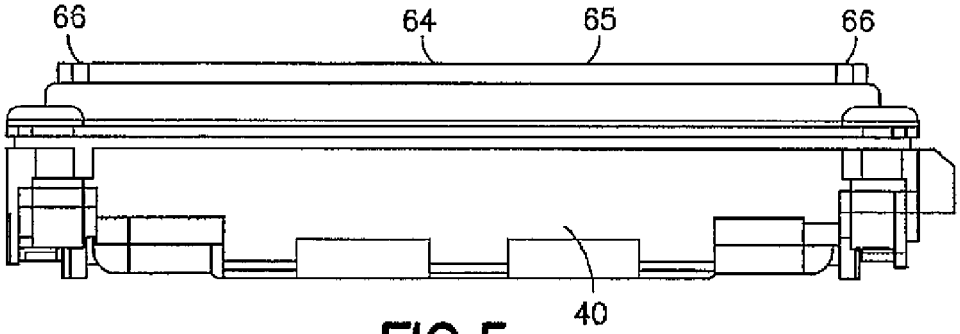
FIG. 5 is a side view of the speaker shown in FIGS. 3-4 with a gasket attached.
Figure 6:
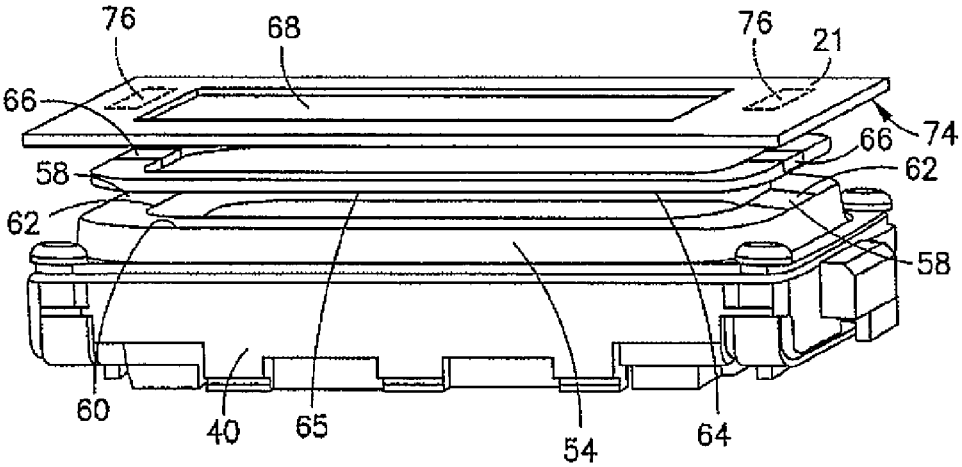
FIG. 6 is an exploded perspective view of the speaker and gasket shown in FIG. 5 with a portion of a printed wiring board.

Referring also to FIG. 5, a gasket 64 may be provided to mount the transducer 40 to the housing 12 and/or the printed wiring board 21. FIG. 6 shows an exploded view of the gasket 64 being used to attach the transducer 40 to the printed wiring board 21 for example. The gasket 64 may be comprised of material which is slightly resilient, but may alternatively not be resilient. The gasket 64 has a general ring shape with a central open area for air to move based upon vibrations/movement of the diaphragm 48. The gasket specifications may change based on the smartphone design. In some products, a softer gasket is used whereas in other products harder material is chosen. In full assembly, the compression factor of the gasket may also be considered. The gasket should still provide an acoustic sealing functionality. Although this part is called a "gasket" herein, it may also be referred to as 'adhesive tape' which can be very thin. Conventionally, a gasket with an adhesive tape or a double injection molded slot is also used to seal the respective section of the speaker. There are usually force limits provided by the speaker manufacturer. Such force limits in full assembly should not be exceeded; so as not to negatively influence the performance of the speaker component. Gasket dimensions, material relaxation, gasket compression, tolerances and forces may considered. The gasket could be a Poron material for example. In some designs, and it may depend on which side of the transducer is sealed, it may be desirable to have a natural leak (capillary leak). In some transducers, both sides of the transducer may use separate gaskets.

The gasket 64 is sized and shaped to have it rear side located against the front face 60 of the cover 54 and have its front side located against the housing 12 or printed wiring board 21. The shape of the gasket may depend on the shape of the transducer. Some transducers can be rectangular, whereas others are circular or oval shape. So, in practice, the gasket shape may be relative to the transducer shape. In practice, the gasket may be located on the rear surface of the transducer or even on the side of the transducer.

The gasket 64 may be attached to the front face 60 of the transducer such as by use of adhesive or adhesive tape for example. The adhesive or adhesive tape may be a layer which is merged with the gasket, such as a sandwich like structure, where the gasket and the adhesive tape are stacked together. More than one type of adhesive may be used along different locations of the front face 60. For example, electrically conductive adhesive may be used at contact areas 62 and electrically non-conductive adhesive may be used at the rest of the front face 62. As another example, electrically non-conductive adhesive may be used at all locations of the front face 60 except at contact areas 62 where no adhesive is used.

The gasket 64 includes a main dielectric portion 65 and two electrically conductive sections or portions 66. The main dielectric portion 65 may be comprised of slightly resilient compressible material. In an alternate example the main dielectric portion 65 may be comprised of material which is not resilient and/or not compressible. The portions 66 may be substantially rigid in this example, but may be slightly resilient and/or compressible in an alternate example. The portions 66 may be integrally formed with the rest of the gasket. Thus, the portions 66 may form at least part of the gasket 64. In one example the height of the portion 65 may be higher than the height of the portions 66. Rear facing sides of the portions 66 are suitably sized and located to contact the portions 58 of the cover 54 when the gasket 64 is attached to the transducer. The front facing contact areas 62 are suitably sized and located to contact the electrical conductors on another member when the gasket 64 is attached to the other member.

The gasket 64 may be attached to the face 74 of the printed wiring board 21 facing the transducer 40 such as by use of adhesive for example. More than one type of adhesive may be used along different locations of the face 74. For example, electrically conductive adhesive may be used at contact areas 66 and electrically non-conductive adhesive may be used at the rest of the gasket adjacent the face 74. As another example, electrically non-conductive adhesive may be used at all locations of the gasket 64 adjacent the face 74 except at contact areas 66 where no adhesive is used.

Please note that the attachment methods described above with respect to attaching the gasket to the transducer, and attaching the gasket to the printed wiring board, are merely examples. The gasket could be designed at the manufacturing phase of the transducer. One transducer component may comprise both a transducer and a gasket and, therefore, both transducer and gasket can form a single component. Any suitable connection may be provided with the result that the coil 42 is electrically connected to conductors on the printed wiring board and the housing of the transducer is physically attached to the printed wiring board. This may be done without the need to use separate spring contact terminals as in a conventional electrical connection of a micro speaker.

With the example shown in FIG. 6, the portions 58, 66 provide an electrical connection from the leads of the coil 42 to contact pads 76 of conductive traces on the printed wiring board 21. In other words, the portions 58, 66 are electrically conductive sections which provide an electrical interface so that the transducer is suitably interfaced with main circuitries. When the gasket 64 is sandwiched between the transducer 40 and the printed wiring board 21, the electrical conductor sections 66 electrically connect the portions 58 to the conductive traces at the contact pads 76. Thus, the gasket 64 and the housing 50 are able to both electrically connect the coil 42 to the printed wiring board 21 and physically mount the transducer 40 to the printed wiring board. No additional mounting structure is necessary. However, in an alternate example an additional member(s) may be provided for mounting the transducer 40 to the printed wiring board. Also, an additional interface on the gasket 64 and/or housing 50, or an additional but alternative contact interface, such as spring ground contacts for example, may be provided for connection to ground for Electrostatic Discharge (ESD) protection for example.

In the examples described above the electrically conductive portions 58 are substantially rigid. Likewise, the conductive portions 66 are substantially rigid. The front cover or front face 60 could be designed by a porous or rubberized material. Therefore, it could be compressible in assembly. Also, the contact pads 76 on the printed wiring board are substantially rigid. When the transducer 40 and gasket 64 are mounted to the printed wiring board 21, the conductive portions 58, 66 sandwich into contact with the contact pads 76 without any significant spring action of the portions 58, 66. However, in one type of example embodiment the conductive portions 66 may be slightly compressible, such as to accommodate tolerances for example.

In this example the printed wiring board 21 includes an aperture or hole 68. The hole 68 is provided to allow air to move based upon vibrations/movement of the diaphragm 48. Thus, the holes of the gasket 64 and the printed wiring board 21 may be aligned in front of the diaphragm 48. In alternative embodiments the gasket may comprise a cut out so that sound waves could leak through the opening inside the gasket sideways. This way, there is no need to have an opening in the PWB. It is called side firing in conventional techniques where sound waves are routed to the side of the device. This is how some products comprise outlets on the side band. Instead of fully circumferencing the perimeter of the transducer, the gasket could partially cover a surface of the transducer so as to route sound waves sideways.

Features as described herein may be used in regard to a transducer construction and, in particular, to an electrical interface of a micro speaker. Conventional speaker components are designed with leaf or spring contacts. The height of the conventional micro speaker is increased by the existence of the electrical contacts extending from the bottom of the speaker. The speaker components must also be carefully integrated inside a device, such as a portable electronic device, because these leaf or spring contacts must be forced within a certain compression range in full assembly. Failures during use can increase depending on how the micro speaker components are integrated inside mechanics. Such conventional micro speakers can also be damaged during subassembly and during transportation.

Features as described herein may be used with a micro speaker component and its electrical interface in integration for a portable device. In one example there is provided a transducer chassis or a cover on the front surface of the transducer which accommodates conductive sections. In an alternative embodiment, the conductive sections can be provided on the rear of the transducer component or even a lateral side of the transducer. These conductive section(s) may be used to replace one or more conventional electrical terminals (spring contacts). The conductive sections may be electrically coupled to respective conductive sections of a gasket design when the gasket is positioned over the transducer. The gasket may also comprise conductive sections. The location and size of these conductive sections may be designed according to design specifications, and the location and size can vary across different transducers. The gasket and the transducer may be designed as a single component. Alternatively, the gasket may be positioned over the transducer during the subassembly. A micro speaker gasket is traditionally used in a transducer integration for acoustic sealing of respective sides of transducer integrations. Features as described herein provide a straightforward electrical connectivity when the transducers are assembled into portable devices. The gasket provides acoustic sealing functionality, mechanical cushion functionality for the transducer, and electrical connectivity.

The gasket may comprise electrical conductivity for both sealing and electrical connectivity. Conventionally, loudspeaker components are manufactured by a loudspeaker manufacturer without any gasket. Some manufacturers do propose a gasket design. However, the actual gasket is designed by a separate gasket manufacturer. The device manufacturer can assemble both the transducer and the gasket in their production company. Alternatively, with features as described herein, the transducer manufacturer can design both transducer and gasket together.

As noted above, a conventional speaker, such as used in a portable device such as a smartphone for example, has spring contacts to connect the leads of the coil to another member, such as a printed wiring board for example. Conventionally, leaf contacts are also used as well as spring contacts. The main purpose of such electrical contacts is to provide electrical interface between the transducer and PWB and, therefore, the transducers are electrically connected to suitable amplifiers. In the case of digital microphones, such as MEMS for example, they require multiple terminals such as for biasing, ground, clock input, data output from the microphone, left/right channel selection terminal, etc., for example. A printed wired board (PWB) still provides required electrical interfaces. However, these transducers can be indirectly interfaced with PWBs depending on the location of transducers within the device mechanics. Sometimes, a flexi board or flexi connector can be used that is interfaced with the main PWB. Although such integration techniques are known, the features as described herein are suitable for any integration techniques.

Although example embodiments described herein are based on speaker components, features as described herein may be utilized for microphone components, such as so that the a microphone can be directly coupled to a device cover for example. Some conventional moving coil loudspeakers comprise three major components; a diaphragm, a coil and a magnet. However features as described herein are also applicable to audio transducers that do not include a coil and a magnet assembly, for example piezo electric loudspeakers where voice coil and magnet components do not exist. MEMS (micro electrical mechanical system) or ECM (electret condenser microphone) microphones do not include a coil and a permanent magnet either. All miniaturized audio transducer modules and in particular loudspeaker modules can benefit from features as described herein. In the "coil" example described above, the coil alone or with other parts of the apparatus may form a driver for the apparatus. An additional driver, such as an amplifier, may be connected to the driver coil. In the "piezo" transducer example described above the construction of the piezo transducer may form a driver to move the diaphragm and, therefore, becomes a driver for the apparatus. An additional driver, such as an amplifier, may be connected to the driver piezo. Thus, the term "driver" as used herein does not necessarily mean an amplifier.

In an example embodiment, two conductive sections are designed on the front surface of the transducer. An example embodiment may have a transducer with a front cover, where the cover comprises conductive sections for electrical connectivity. A gasket comprising conductive sections may also be designed and positioned onto the transducer. The gasket can be coated with a conductive material, and/or the gasket may be designed with conductive material.

Features as described herein may be used to reduced transducer height, provide robust integration of the electrical interface, provide easy packaging and straightforward sub-assembly, possibly reduce electromagnetic field returns, and provide electrical connectivity and sealing with use of a same single part (i.e., a gasket).

Figure 7:
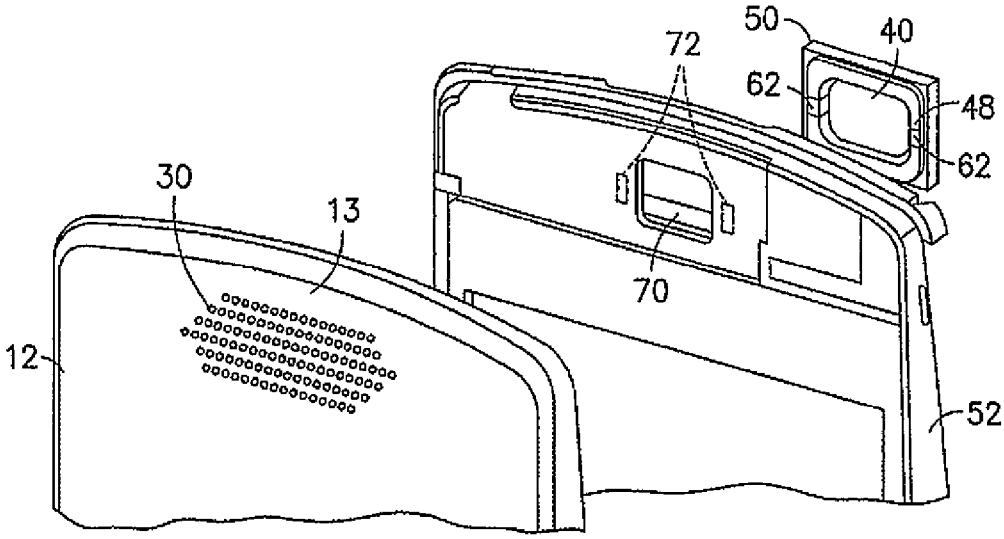
FIG. 7 is a partial exploded perspective view of an alternate example of mounting the speaker.

Referring also to FIG. 7, an alternate example embodiment is shown where the transducer 40 is connected to an internal frame member 52 of the housing 12. In this example a rear cover 13 of the housing 12 has sound holes 30 for the speaker 40. The frame member 52 has a sound conduit 70 and two contacts or contact pads 72 thereon. The contacts 72 are connected to electrical conductors extending along the frame member 52 configured to attach to another member, such as the printed wiring board 21 for example. When the transducer 40 is attached to the frame member 52, the contact pads 62 automatically electrically connect to the contacts 72. This example could also be used with a gasket similar to the gasket shown in FIGS. 5-6.

An example embodiment may be provided in an apparatus comprising a transducer 40 configured to generate sound and a structure 50 configured to physically mount the transducer to another member 12, or 21, or 52, where the transducer comprises a coil 42 and a housing 50, where the structure comprises at least part of the housing, where the structure comprises at least one portion 58 which is electrically conductive, and where the at least one portion is electrically connected to the coil.

The description that the "structure" is configured to physically mount the transducer to another member and that the structure comprises at least part of the housing, is provided in the example embodiment of FIG. 4 where no gasket is used and, instead, the face 60 is attached to the "another member" with adhesive. The description that the structure is configured to physically mount the transducer to another member and that the structure comprises at least part of the housing, is also provided in the example embodiment of FIG. 6 where a gasket is used as part of the structure to attach the transducer to the "another member" with adhesive (or when the gasket is adhesive tape). These are only some examples and should not be considered as limiting.

The structure may comprise merely a part of the housing which is subsequently connected to the another member, such as with adhesive for example, or may comprise a part of the housing and at least one other component, such as the gasket for example. If a manufacturer assembled a device housing with a gasket, the manufacturer could then locate the transducer onto such structure within the device housing. The gasket could be separately manufactured and then assembled onto the transducer. The front cover may comprise the gasket, but this is not necessary. A transducer can be designed with conductive sections. A gasket can be designed suitable for placing such gasket onto a specially designed transducer comprising said conductive sections. A device manufacturer could assemble both the gasket and the transducer together inside a device such as a smartphone for example. Alternatively, the transducer and the gasket can be manufactured together as a unitary structure.

The apparatus may comprise no separate spring terminals mounted to the housing. The at least one portion may comprise at least one electrically conductive section of the housing. The at least one electrically conductive section of the housing may comprise an electrically conductive trace on the housing. The at least one electrically conductive section of the housing may comprise at least one contact area at a front side of the housing. The at least one electrically conductive section of the housing may comprise at least one contact area at a rear side of the housing. The structure may comprise a gasket having the at least part of the at least one portion thereon. The structure may comprise a gasket having a first one of the at least one portion connected to a second one of the at least one portion on the housing. The gasket may be mounted to a front cover of the housing.

Figure 8:
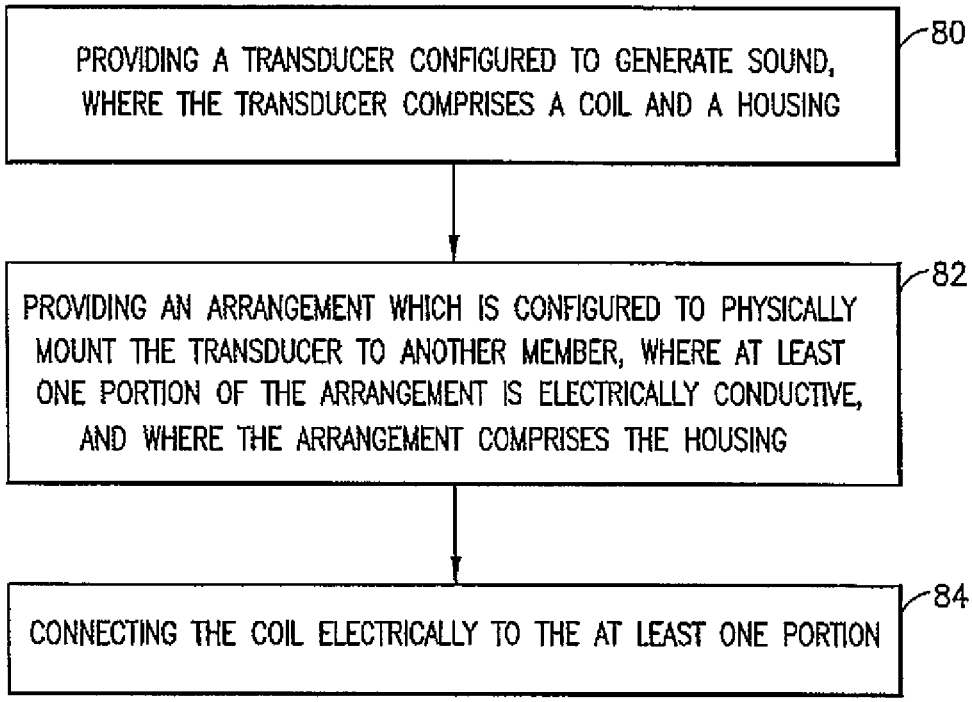
FIG. 8 is a diagram illustrating an example method.

Referring also to FIG. 8, an example method may comprise providing a transducer configured to generate sound as indicated by block 80, where the transducer comprises a coil and a housing; providing an arrangement which is configured to physically mount the transducer to another member as indicated by block 82, where at least one portion of the arrangement is electrically conductive, and where the arrangement comprises at least a part of the housing; and connecting the coil electrically to the at least one portion as indicated by block 84.

An example method may comprise no separate spring terminals being mounted to the housing. The at least one portion may include providing at least one electrically conductive section of the housing. The at least one electrically conductive section of the housing may include providing as at least one electrically conductive trace on the housing. The at least one electrically conductive section of the housing may include providing at least one contact area at a front side of the housing. The at least one electrically conductive section of the housing may include providing at least one contact area at a rear side of the housing. The arrangement may include providing a gasket having the at least part of the at least one portion thereon and connecting the gasket to the housing. The arrangement may include a gasket having a first one of the at least one portion connected to a second one of the at least one portion on the housing. The gasket may be mounted to a front cover of the housing.

An example embodiment may be provided in an apparatus comprising a transducer configured to generate sound, where the transducer comprises a coil and a housing; and a gasket connected to the housing, where the gasket comprises at least one portion which is electrically conductive, and where the at least one portion is electrically connected to the coil.

An example embodiment may be provided comprising means for providing a transducer configured to generate sound, where the transducer comprises a coil and a housing; means for providing an arrangement which is configured to physically mount the transducer to another member, where at least one portion of the arrangement is electrically conductive, and where the arrangement comprises the housing; and means for connecting the coil electrically to the at least one portion.

Features as described in U.S. Pat. No. 8,692,635, which is hereby incorporated by reference in its entirety, may also be used with features as described herein. Features as described in U.S. patent application Ser. No. 14/087,078 filed Nov. 22, 2013, which is hereby incorporated by reference in its entirety, may also be used with features as described herein.

Features as described herein may be used for vibra modules as well. A vibra module is used for vibra functionality providing a vibra signal. A vibra module also comprises electrical terminals, and the features as described herein may be utilized for vibra modules. A vibra module can be classified as audio transducer in the field. In addition, the features as described herein may be used for a speaker box. A speaker box may include the transducer and respective acoustic cavities, but also comprise electrical terminals in conventional techniques. Features as described herein may be used to replace one or more of the electrical terminals in a speaker box.

In the examples described above the electrical conductors 58 and 66 may be compressed when the audio transducer is connected to the PWB 21. This compression may assist in a good electrical contact at the compressed surface areas. Fusible material, such as solder for example, and/or electrically conductive adhesive may be used for connection to the conductors 58, 66. The conductors 58, 66 may be substantially rigid, but still be compressible for a good electrical connection. In one example embodiment electrical conductor 58 may be rigid (not compressible) whereas electrical conductor 66 may be compressible (since the electrical conductor 66 may comprise softer or rubberised material for example). In another example embodiment the face 60 (i.e. front cover) may be designed with a gasket-like design. The front cover may be semi-rigid and compressible, so that the front cover can function as a front cover, as a gasket, and as an electrical interface. With this type of example embodiment a single transducer component may be directly dropped or placed into the mechanics of the portable device during assembly or, alternatively, a very thin layer adhesive tape may be used to firmly position the speaker component. The adhesive tape may include conductive and/or non-conductive sections.

In one example embodiment a gasket 64 is provided comprising a first section 65 and a second section 66. The first section 65 is electrically non-conductive. The second section 66 is electrically conductive and comprises one or more contact areas, such as contact areas on opposite front and rear sides. The gasket is configured to electrically connect electrical terminals on a housing of an audio transducer to another member (such as a printed wiring board for example). The gasket is configured to where a gasket is used as part of the structure to attach the transducer to the "another member", and the gasket also may provide acoustic sealing functionality between the "another member" and the audio transducer. This may include providing acoustic leakage and/or acoustic path definition (at least partially) via the gasket.

It should be understood that the foregoing description is only illustrative. Various alternatives and modifications can be devised by those skilled in the art. For example, features recited in the various dependent claims could be combined with each other in any suitable combination(s). In addition, features from different embodiments described above could be selectively combined into a new embodiment. Accordingly, the description is intended to embrace all such alternatives, modifications and variances which fall within the scope of the appended claims.

What is claimed is:

1. An apparatus comprising an audio transducer configured to generate sound and a structure configured to electrically interface the audio transducer with circuitry of an electronic device when the audio transducer is received by the electronic device, where the audio transducer comprises a housing, a diaphragm and a driver configured to move the diaphragm, where the housing at least partially comprises the structure, where at least one portion of the structure is electrically conductive and connected to the driver, and where the structure is further configured to provide an acoustic sealing functionality with the electronic device when the audio transducer is connected to the electronic device.

2. An apparatus as in claim 1 where the apparatus comprises no separate spring electrical contact terminal or leaf electrical contact terminal for the driver mounted to the housing of the transducer.

3. An apparatus as in claim 1 where the at least one portion of the structure comprises at least one electrically conductive section of the housing which is stationary on the housing of the transducer.

4. An apparatus as in claim 3 where the at least one electrically conductive section of the housing comprises an electrically conductive trace on the housing.

5. An apparatus as in claim 3 where the at least one electrically conductive section of the housing comprises at least one contact area at a front side of the housing.

6. An apparatus as in claim 3 where the at least one electrically conductive section of the housing comprises at least one contact area at a rear side of the housing.

7. An apparatus as in claim 3 where the structure comprises a gasket, where the gasket comprises an electrically conductive section which is located against the at least one electrically conductive section of the housing of the transducer.

8. An apparatus as in claim 7 where the gasket is mounted to a front cover of the housing.

9. A device comprising:

the apparatus as claimed in claim 1;

at least one printed wiring board, where the apparatus is mounted to a first one of the at least one printed wiring board, where the first printed wiring board forms the electronic device;

an electrical display connected to the at least one printed wiring board;

a receiver connected to the at least one printed wiring board;

a transmitter connected to the at least one printed wiring board;

a processor connected to the at least one printed wiring board;

a memory connected to the at least one printed wiring board; and a battery connected to the at least one printed wiring board.

10. An apparatus as in claim 1 where the at least one electrically conductive portion of the structure is configured to form at least a portion of an acoustic seal.

11. An apparatus as in claim 1 where the at least one electrically conductive portion of the structure is at a flexible portion of the housing.

12. An apparatus as in claim 1 where the diaphragm is located proximate a front side of the audio transducer and where the at least one electrically conductive portion of the structure is located at the front side of the audio transducer.

13. An apparatus as in claim 1 where the at least one electrically conductive portion of the structure is on a compressible portion of the housing.

14. An apparatus as in claim 1 where the structure is configured to attach a gasket thereto, such that a combination of the at least one electrically conductive portion of the structure and the gasket are configured to at least partially provide at least one of:

the acoustic sealing functionality for the audio transducer;

a mechanical cushion functionality for the audio transducer; and an electrical conductivity for the audio transducer.

15. An apparatus as in claim 14 where the gasket comprises adhesive tape attached to the housing.

16. An apparatus as in claim 14 where the gasket is attached to the housing and comprises at least one dielectric portion and at least two electrically conductive sections.

17. An apparatus as in claim 1 where the structure is configured to physically mount the audio transducer to the electronic device, where the at least one electrically conductive portion of the structure is an integrally formed part of the housing being at least one of: molded in, printed, glued, laser glued, and overmolded.

18. A method comprising:

providing an audio transducer configured to generate sound, where the audio transducer comprises a housing, a diaphragm and a driver for moving the diaphragm;

providing an arrangement which is configured to physically mount the audio transducer to an electronic device, where at least one portion of the arrangement at least partially comprises the housing, where the at least one portion of the arrangement is electrically conductive, and where the at least one electrically conductive portion of the arrangement and at least one other portion of the arrangement are configured to provide an acoustic sealing functionality when the audio transducer is connected to the electronic device; and connecting the driver electrically to the at least one portion.

19. A method as in claim 18 where no separate electrical spring contact terminals are mounted to the housing of the transducer.

20. A method as in claim 18 where the at least one portion of the arrangement includes providing at least one electrically conductive section of the housing which is stationary on the housing of the transducer.

21. A method as in claim 20 where the at least one electrically conductive section of the housing includes providing at least one electrically conductive trace on the housing.

22. A method as in claim 20 where the at least one electrically conductive section of the housing includes providing at least one contact area at a front side of the housing.

23. A method as in claim 20 where the at least one electrically conductive section of the housing includes providing at least one contact area at a rear side of the housing.

24. A method as in claim 18 where the arrangement comprises providing a gasket, where the gasket comprises an electrically conductive section which is located against the at least one electrically conductive portion of the arrangement and electrically connecting the gasket to the housing.

25. A method as in claim 24 where the gasket is mounted to a front cover of the housing.

26. An apparatus comprising:

an audio transducer configured to generate sound, where the transducer comprises a housing, a diaphragm and a driver for moving the diaphragm; and a gasket connected to the housing, where the gasket comprises at least one portion which is electrically conductive, and where the at least one electrically conductive portion of the gasket is electrically connected to the driver, where the at least one electrically conductive portion of the gasket and at least one other portion of the gasket form an audio transducer acoustic sealing functionality.

27. An apparatus as in claim 26 where an electrically conductive portion of the housing comprises a stationary electrical trace on at least one housing member of the housing.

28. An apparatus as in claim 26 where the apparatus comprises an electrical interface structure, configured to electrically interface the audio transducer with circuitry of an electronic device when the audio transducer is connected to the electronic device, where the electrical interface structure comprises the at least one electrically conductive portion of the gasket and at least one electrically conductive portion of the housing, and where the electrical interface structure is configured to provide an acoustic seal between the audio transducer and the electronic device when the audio transducer is connected to the electronic device by the gasket.

29. An apparatus as in claim 26 where the at least one electrically conductive portion of the gasket is electrically connected to the driver by at least one electrically conductive portion of the housing.

30. An apparatus as in claim 26 where the at least one electrically conductive portion of the gasket at least partially forms the audio transducer acoustic sealing functionality at a joint between the audio transducer and the gasket.

* * * * *